US005833224A

United States Patent [19]

Holte

[11] Patent Number: 5,833,224

[45] Date of Patent: Nov. 10, 1998

[54] JAR CLAMP

[76] Inventor: Mark D. Holte, 5483 Fist Lake Dam Rd., Duluth, Minn. 55803

[21] Appl. No.: 840,654

[22] Filed: Apr. 24, 1997

[51] Int. Cl.[6] ..... B25B 1/04

[52] U.S. Cl. ..... 269/130; 81/64

[58] Field of Search ..... 81/64, 68, 69, 81/331–338, 3.43; 294/31.2; 269/130–132, 3, 6; 29/268, 267

[56] References Cited

U.S. PATENT DOCUMENTS

| | | | |
|---|---|---|---|
| 409,148 | 8/1889 | Haller . | |
| 438,043 | 10/1890 | Webster . | |
| 470,846 | 3/1892 | Cummins . | |
| 624,253 | 5/1899 | Rudebock . | |
| 705,596 | 7/1902 | Morith . | |
| 720,816 | 2/1903 | Karl . | |
| 839,405 | 12/1906 | Mortimer . | |
| 1,316,705 | 9/1919 | Franke . | |
| 1,456,126 | 5/1923 | Friday . | |
| 2,389,301 | 11/1945 | Escher . | |
| 2,521,189 | 9/1950 | Smythe et al. . | |
| 2,531,052 | 11/1950 | Kehoe . | |
| 2,562,055 | 7/1951 | Miller . | |
| 3,064,325 | 11/1962 | Nester | 81/64 |
| 3,292,922 | 12/1966 | Nastev . | |
| 3,584,860 | 6/1971 | Ervin . | |
| 3,635,104 | 1/1972 | Taylor et al. | 269/130 |
| 3,669,439 | 6/1972 | Sanchez . | |
| 3,859,694 | 1/1975 | Lafond et al. | 81/68 |
| 4,532,833 | 8/1985 | Downs . | |
| 5,097,729 | 3/1992 | Brown . | |
| 5,249,720 | 10/1993 | White et al. | 81/331 |
| 5,390,570 | 2/1995 | Reisner | 81/64 |

*Primary Examiner*—Robert C. Watson
*Attorney, Agent, or Firm*—Palmatier, Sjoquist, Voigt & Christensen, P.A.

[57] ABSTRACT

A jar clamp for stabilizing a jar so as to prevent slipping and twisting of the jar during opening of the jar, for freeing both hands so that they may be free to work at opening the jar lid, and for accommodating a wide array of jar diameters. The jar clamp incorporates a second elongate arm that is hingedly attached to a first elongate arm. A seat having a central strut as well as upper and lower cross bars is affixed to the first arm. The seat further incorporates rubberized padding and angled end portions on the upper and lower cross bars. A rubber or elastic rubberized strap is provided that is affixed to the second arm and releasably secured to the first arm.

6 Claims, 2 Drawing Sheets

JAR CLAMP

BACKGROUND

This invention relates to clamps directed toward everyday household use and more particularly to clamps that are adapted to stabilize a glass jar or container in an upright position so as to prevent slipping and twisting of the jar or container during opening.

For those who have small hands, arthritic hands or those who face other physical handicaps reducing mobility of the hands, the task of stabilizing and opening a jar can be difficult, frustrating and for many, an impossible task. Often, the hands are simply not large enough, flexible enough or strong enough to position and hold a jar in an upright position with one hand so that the free hand may attempt to open the jar lid. Ultimately, the jar twists or slips in a one-handed grip and the individual is unable to twist the lid open or if an open lid is achieved, the torque applied in opening the lid forces the jar from the gripping hand and a spill of the contents of the jar results.

While there are a number devices that are directed toward the removal of jar lids there are few devices that are directed to the purpose of actually holding and stabilizing a jar so that both hands may be free to pry ajar lid open. U.S. Pat. No. 409,148 and U.S. Pat. No. 438,043 each disclose devices for holding fruit jars. The idea behind each of these patents is the ability to handle hot canning jars without ever touching them so as to avoid bums and contamination of the food within—holding and stabilizing of the jar for removal of the lid is not an interest. U.S. Pat. No. 470,846 describes simply ajar holder having handles with interlocking teeth. This patent, along with two aforementioned patents, describe devices that have narrow handles requiring much hand dexterity to operate. Further, each requires that the device be lifted and wrapped about a jar, again requiring much hand dexterity to operate. Additionally, the '148 and '846 patents each provide a rounded end shape to at least one of their handles. This rounded shape is adapted to conform to the curvature of a jar. As the rounded shape is not variable, only limited jar diameters are appropriate to the device, smaller jars will slip within the rounded shape while larger jars will not rest within the rounded shape and thus, will also slip. U.S. Pat. No. 2,531,052 describes ajar holder that is mounted to a counter top. In this instance, much hand dexterity is required to secure the jar holder mounting bracket to the counter top as well as to pull and secure the thin wire spring necessary to the invention. Further, the device provides no manner of preventing the jar from slipping, sliding and being pushed forward as the strap is secured about the jar. Moreover, the width of the back plate necessarily limits the diameter ofjars the holder may be used with; a small back plate eliminates the gripping of very large jars while a large plate eliminates the gripping of very small jars.

In light of the above, there is a need for ajar clamp that will handle an expanded array of jar diameters, will eliminate the need for lifting the jar during use of the clamp, will prevent slipping and sliding of the jar while it is being secured to the clamp, will secure and stabilize the jar for opening without requiring extensive hand and finger dexterity, and will allow both hands to be free to work at opening ajar lid.

SUMMARY

A jar clamp for stabilizing a jar so as to prevent slipping and twisting of the jar during opening of the jar, for freeing both hands so that they may be free to work at opening the jar lid, and for accommodating a wide array of jar diameters. The jar clamp incorporates a second elongate arm that is hingedly attached to a first elongate arm. A seat having a central strut as well as upper and lower cross bars is affixed to the first arm. The seat further incorporates rubberized padding and angled end portions on the upper and lower cross bars. A rubberized or elastic rubberized strap is provided that is affixed to the second arm and releasably secured to the first arm.

An object and advantage of the present invention is to provide ajar clamp having a seat that will prevent slipping and sliding of the jar while it is being secured to the clamp.

Another object and advantage of the present invention is to provide a jar clamp that will secure and stabilize the jar for opening without requiring extensive hand and finger dexterity or strength and that will free both hands so that they may be used in opening the jar lid.

Another object and advantage of the present invention is to provide a jar clamp having a seat that will accommodate virtually any size jar diameter.

Another object and advantage of the present invention is to provide a jar clamp having hinged arms, with outward extending handles, that can be pressed proximate each other thereby providing extra tension to the strap surrounding the jar and providing additional securement of the jar, all of this performed with minimal rotation of the hands.

Another object and advantage of the present invention is that the jar clamp need never be lifted. All operations of the jar clamp may be performed with the jar clamp sitting on a flat surface. Further, because the jar clamp is designed to rest upon a flat surface, clamp a jar sitting on that same flat surface, and hold the jar in an upright, vertical position, there is little, if any, possibility of spilling the contents of the jar.

Another object and advantage of the present invention is the provision of a rubber or elastic rubberized strap that is wrapped around the jar and secured to the arms of the clamp. The rubberized feature of the strap helps further to secure and stabilize the jar. Additionally, the strap may be provided with perforations which are easily slid over a bent pin to quickly and easily secure the strap. Alternatively, the strap may be corrugated so as to be quickly and easily secured with a pivoting buckle.

DESCRIPTION OF THE DRAWINGS

These and other features, aspects, and advantages of the present invention will become better understood with regard to the following description, appended claims, and accompanying drawings where:

DETAILED DESCRIPTION

Figure 1:
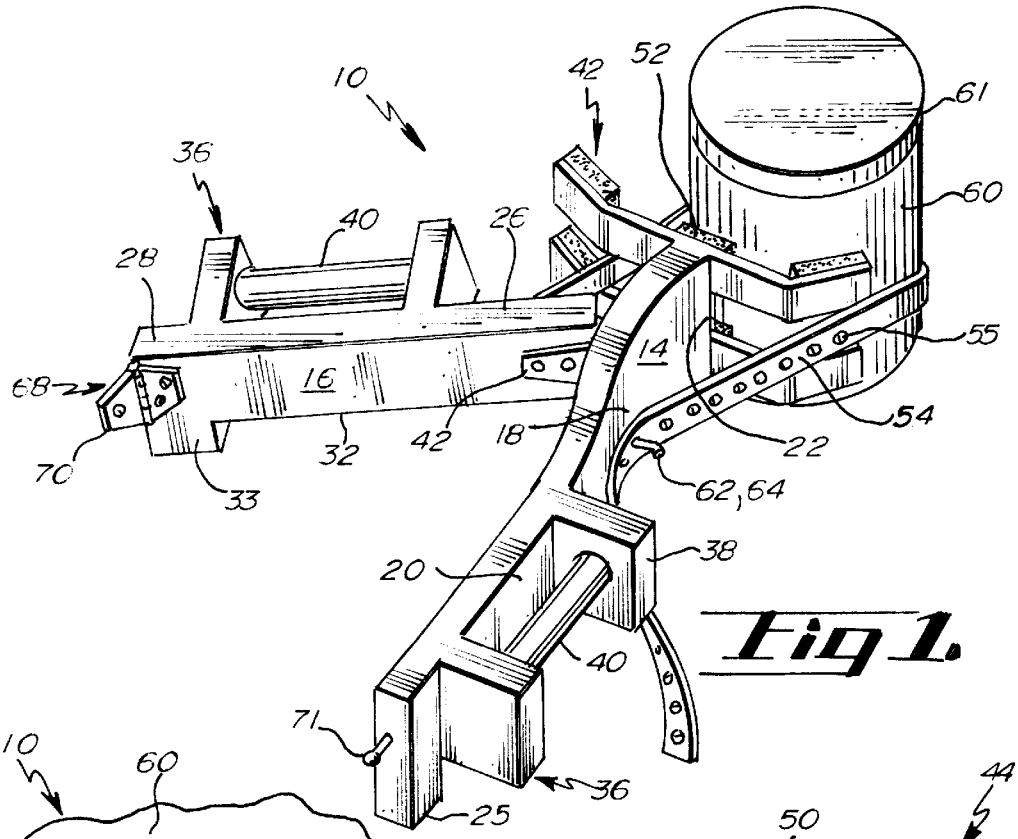
FIG. 1 is top view of the jar clamp wherein the strap securement device is a bent pin.
Figure 2:
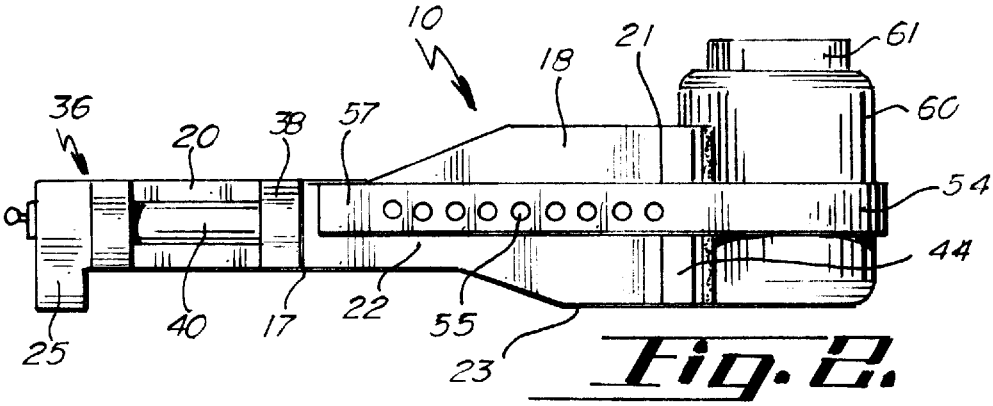
FIG. 2 is side view of the jar clamp shown in FIG. 1.

Referring to FIGS. 1 and 2, the jar clamp 10 generally comprises a first arm 14, a second arm 16, a seat 44 and a strap 54.

The first arm 14 is generally rectangular and elongate in shape with the bottom side 17 of the arm 14 tapering from the forward portion 18 of the arm 14 to the rear portion 20 of the arm 14. The first arm 14 incorporates a vertical front face 21, an outer edge 22, an inner edge 24 and a flat resting surface 23. A leveling extension 25 extends downward from the rear portion 20 of the arm and provides additional stability for the jar clamp 10 when resting on a flat surface. The second arm 16 is also generally rectangular and elongate in shape. Noticeably, the second arm 16 is slightly shorter than the first arm 14. By way of illustrative example, the first arm 14 may be twelve inches in length with the second arm 16 at a slightly shorter length of ten inches. The second arm 16 has a forward portion, a rear portion, an outer edge 30, an inner edge 32 and a leveling extension 33 identical to that found on the first arm 14. Depending on the length of the arms and whether the features are desired, the second arm 16 may also include the tapering feature and/or the flat resting surface feature of the first arm 14.

Figure 4:
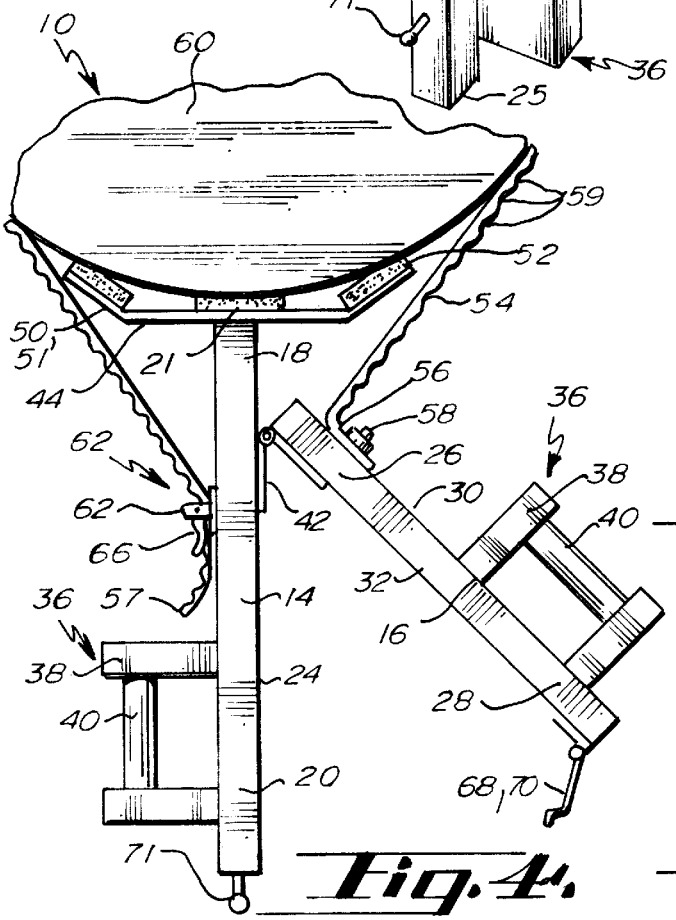
FIG. 4 is top view of the jar clamp showing the use of a corrugated strap and a pivoting buckle as the strap securement device

Each of the arms 14, 16 may also include large outward extending handles 36. As shown in FIGS. 1 and 4 each of these handles appropriately incorporates two posts 38 that are secured to or incorporated into the outer edges 22, 30 of the arms 14, 16 and a dowel-like cross bar 40 that spans the distance between the posts 38. Alternatively, the post 38 and cross bar 40 configuration of the handles 36 may be replaced by a large outward extending bowed handle portion formed into the overall shape of the arms 14, 16 themselves. As another alternative, the posts 38 and the cross bar 40 may be replaced by a single piece handle of arched profile with edges rounded by router, or molded; the to handle secured to or incorporated into the outer edges 22, 30 of the arms 14, 16.

The second arm 16 is attached to the first arm 14 by way of a hinge 42. The hinge 42 is affixed to the first and second arms 14, 16 by appropriate securement device or means such that the rear portion 28 of the second arm 16 is flush to the rear portion 20 of the first arm 14 when the two arms 14, 16 are in close proximity, by example see FIGS. 2, 5A and 5B. While a preferred embodiment of the hinge 42 configuration is shown, other appropriate hinge configurations may also be used.

Figure 3A:
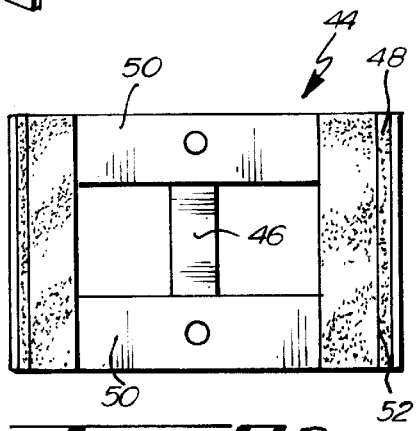
FIG. 3A is front view of the jar clamp seat alone, the seat having two side bars.
Figure 3B:
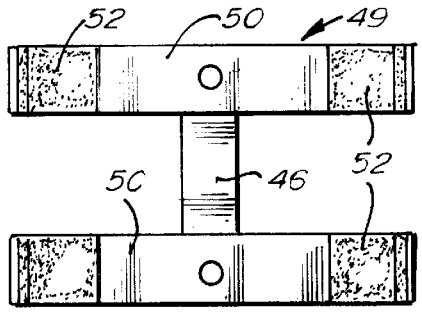
FIG. 3B is a front view of an alternative embodiment of the jar clamp seat, the side bars of FIG. 3A are eliminated.

Attached to or incorporated into the front face 21 of the first arm 14 is a seat 44. The seat 44 embodies a vertical central strut 46 that is approximately parallel to and of the same length as the front face 21, upper and lower cross bars 50 that are perpendicular to the strut 46 and side bars 48 that are parallel to the strut 46. The components 46, 48, 50 of the seat 44 may be formed of a single piece of material or may be individual pieces that are secured together. The upper and lower cross bars 50 incorporate angled end portions 51 and while any angle from 20° to 80° may be used the preferred angle is approximately 45°, as shown in FIGS. 1 and 4. The seat 44 is equipped with a rubber or elastic rubberized padding 52 to help grab as well as cushion the jar 60 (prevent scratching and nicking of the jar 60), the padding 52 may be at any number of specific points or may cover the seat 44. FIG. 3A shows the seat 44 configuration described above—with side bars 48 intact. FIG. 3B reveals an alternative configuration for the seat 44 in which the side bars 48 have been removed.

The strap 54 is preferably of a rubber or elastic rubberized padding material and has a first end 56 and a second end 57. The first end 56 is secured to the outer edge 30 of the second arm 16 by use of a strap anchor 58 such as a bolt/washer/lockwasher/nut combination or other appropriate anchoring device (it is desirable that the strap anchor 58 be appropriate to the idea of having to replace a worn strap 54). The second end 57 of the strap 54 is secured to the first arm 14 through use of a strap securement device 62. In the instance where the strap 54 is of a perforated type, see perforations 55 as detailed in FIGS. 1 and 2, a suitable strap securement device 62 is a bent hook 64 that is permanently affixed by appropriate securement device or means to the outer edge 22 of the forward portion 18 of the first arm 14. The hook is bent to an angle in the range of 90°–180° with a preferred bend of 135°. An angle of 135° allows for easiest securement of the strap. In the instance where the strap 54 is of a corrugated type, see corrugations 59 as detailed in FIG. 4, a suitable strap securement device 62 is that of a pivoting buckle 66 adapted to interlock with the corrugation of the strap 54, the pivoting buckle 66 pivoting about side supports 67 that are affixed to the first arm 14 by appropriate securement device or means. As an alternative, an elastic non-rubberized strap might be used; however, the gripping effect is reduced. As another alternative and to aid in lowering the tension in the rubber strap 54, a coil spring may be added in series with the rubber strap 54; the first end 56 of the strap 54 secured to the coil spring and the coil spring secured to the strap anchor 58. The tension of a coil spring would also allow for the use of a strap made of a non-rubber or an inelastic material although the overall gripping effect could again be reduced.

In operation, the jar clamp 10 is preferably placed upon a flat surface, the flat resting surface 23, 31 of each arm 14, 16 and the leveling extensions 25, 33 of each arm 14, 16 maintain the jar clamp 10 in a level condition. As shown in FIGS. 1 and 4, the initial position of the jar clamp 10 is with the second arm 16 extended outward. The jar 60 is slid into a position against the seat 44; a large diameter jar may rest against the padded central strut 46 and both sides' padded angled end portions 51 while a smaller diameter jar will generally rest between or against one side's padded angled end portions 51 and the padded central strut 46. With the jar 60 in position, the strap 54 is drawn around the jar 60. If the side bars 48 are in place, the strap 54 may be wrapped to the outside of the side bars 48 or may be wrapped to the inside of the side bars 48 entering the space between the upper and lower cross bars 50 (the diameter of the jar 60 may require that the strap be wrapped to the outside of the side bar 48 on one side of the jar 60 and to the inside of the side bar 48 on the opposite side of the jar, see FIG. 1). Note that while the strap 54 is being wrapped about the jar 60, the angled end portions 51 and padding 52 on the seat 44 help to minimize and virtually eliminate any type of slipping of the jar 60.

Once the strap 54 has been wrapped about the jar 60 it is secured to the strap securement device 62. A perforated strap 54, FIGS. 1 and 2, need only have one of the perforations 55 slipped over the bent pin 64 while a corrugated strap 54, FIG. 4, need only be inserted under the pivoting buckle 66 and the buckle 66 pushed downward to engage the corrugation 59. For those whose hands are handicapped, it is important to note that tremendous strength need not be exerted to pull the strap 54 taut rather the strap 54 need only be pulled gently, small amounts of slack in the strap 54 are not of a concern. With the strap 54 secured, the second arm 16 is pushed proximate the first arm 14, the arm 16 itself may be pushed or if handles 36 are present they may be used to position the arm 16 (note that securing the strap 54 and pushing the arms 14, 16 together requires little strength and little hand dexterity; minimal rotational hand movements are necessary). The positioning of the second arm 16 proximate the first arm 14 tightens the strap 54 about the jar 60 and tightens the fit of the jar 60 to the seat 44. As such the rubber strap 54 and rubber padding 52 of the seat 44 serve to from a tight grip about jar 60 so that the jar lid 61 may be removed.

To remove the lid 61, the jar clamp 10 is pushed or placed next to an immovable object so as to be braced against that immovable object allowing both hands to be free to apply torque to the lid 61 in any manner desired. While the jar clamp 10 is designed to free both hands, the jar clamp 10 may be grasped or held down with one hand while the free hand removes the lid 61. The flat resting surface 23 of the arms 14, 16 along with the leveling extension 33 maintain the jar clamp 10 in a level condition, these features along with the seat 44, its rubberized padding 52, its angled end portions 51, and the rubber strap all aid in maintaining the jar 60 in an upright, vertical position and prevent the spilling of the contents of the jar 60.

The jar clamp 10 arms 14, 16 and handles 36 may be made from any number of appropriate materials such as wood, plastic, metal, plastic tubing, metal tubing, wood/plastic composite, wood composite, fiber reinforced plastic composite solid or tubing, and wood/fiber reinforced plastic composite and may be made by any number of processes including but not limited to machining, molding and casting. The seat 44 may be made from the same materials and by the same processes.

As an additional feature, the jar clamp 10 may utilize a latch 68 to secure the two arms 14, 16 proximate one another during the jar clamping process. The latch 68 may preferably be as simple as a "loop and pin" combination where a hinged loop 70 secured to one arm wraps about a pin 71 located on the other arm to secure the arms proximate one another, see FIGS. 1, 2 and 4, or the latch 68 may be a more complicated configuration such as that shown in FIGS. 5A and 5B.

Figure 5A:
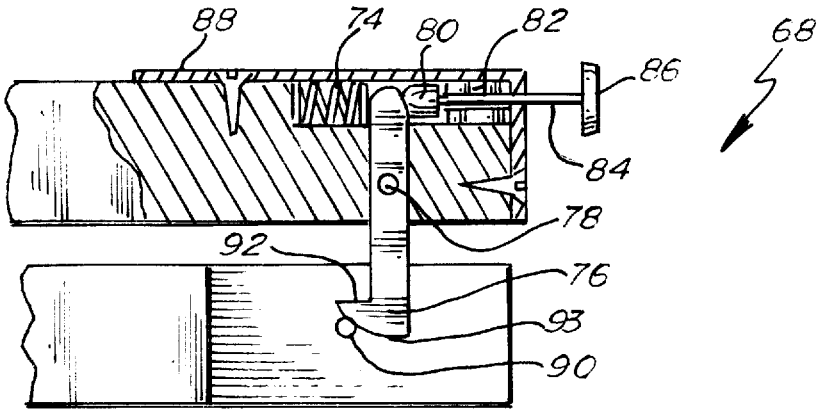
FIG. 5A shows an alternative embodiment of the arm latch.

The latch 68 of FIG. 5A involves a hollowed channel 72 within one of the arms 14, 16. Within the channel 72 is a compression spring 74 placed proximate a latch arm 76 that is secured to the jar clamp arm 14 or 16 with a pivot pin 78. Still within the channel 72 and proximate the latch arm 76 is a plunger block 80. A sleeve or spacer 82, also within the channel 72 holds the plunger block 80 tight to the latch arm 76 yet allows for placement of plunger stem 84 out to the plunger handle 86. A cover plate 88 secured to the arm 14 or 16 maintains the above-described configuration. The latch arm 76 extends out through a slot in the cover plate 88 so that it may engage a locking pin 90 located on the opposite arm 16 or 14: The latch arm 76 has a chamfered hook end 92. When the arms 14, 16 are pushed proximate one another, the locking pin 90 slides down the chamfered edge 93 of the hook end 92 depressing the latch arm 76 back against the compression spring 74. Upon reaching the end of the chamfered edge 93, the compression spring 74 pushes the latch arm 76 forward resulting in the locking pin being positioned in the crook of the hook end 92. To separate the jar clamp arms 14, 16, the plunger handle 86 is depressed thereby moving the hook end 92 of the latch arm 76 back and away from the locking pin 90.

Figure 5B:
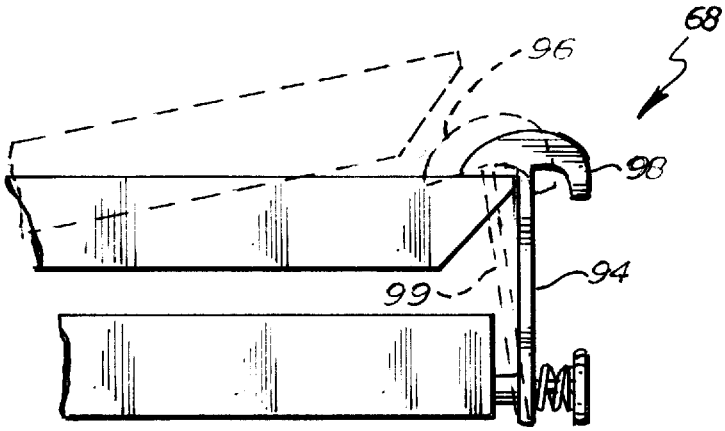
FIG. 5B shows another alternative embodiment of the arm latch.

The latch 68 of FIG. 5B utilizes a hook arm 94 having a forward securement tab 96 and a pull tab 98. This latch 68 configuration also requires that one of the jar clamp arms 14 or 16 have a chamfered edge 99. The hook arm 94, which is of a fairly rigid yet flexible material, is secured to the jar clamp arm 14 or 16 with the non-chamfered edge. Note, that if the hook arm 94 material is not sufficiently flexible a spring may be added between the arm 94 and its connection to the arm 14, 16 to provide additional flexibility. To secure the two arms 14, 16 proximate one another, the arms 14, 16 are pushed toward each other whereby the forward securement tab 96 begins riding on the chamfered edge 99. The forward securement tab 96 then passes the edge 99, slides along side the rear portion of the arm 14 or 16, until snapping on to the outer edge 22 or 30 of the arm 14 or 16 thereby holding the arms 14, 16 in proximate position. To separate the arms 14, 16, the pull tab 98 of the hook arm 94 is pulled backward sliding the forward securement tab 96 off of the outer edge 22 or 30 of the arm 14 or 16 thus, allowing the arms 14, 16 to be separated. Alternatively, if the forward securement 96 is sufficiently large, the pull tab 98 may be omitted and the unlatching accomplished by pressing directly on the securement tab 96.

The present invention may be embodied in other specific forms without departing from the spirit of the essential attributes thereof; therefore, the illustrated embodiment should be considered in all respects as illustrative and not restrictive, reference being made to the appended claims rather than to the foregoing description to indicate the scope of the invention.

What is claimed:

1. A jar clamp for stabilizing a jar so as to prevent slipping and twisting of the jar during opening of the jar, for freeing both hands so that they may be free to work at opening the jar lid, and for accommodating a plurality of jar diameters, comprising:

(a) a first elongate arm and a second elongate arm, said second elongate arm hingedly attached to said first elongate arm;

(b) a seat affixed to said first elongate arm, said seat having a vertical central strut, an upper and lower cross bar perpendicular to said vertical central strut, and rubber padding secured to said vertical strut and said upper and lower cross bars, said upper and lower cross bars each having angled end portions;

(c) a rubber strap having a first and second end, said first end affixed to said second arm, said second end adapted to pass between said upper and lower cross bars, said second end adapted to be releasably secured to said first arm; and, (d) a latch comprising a latch arm, a pivot pin, a compression spring and a plunger, the latch releasably maintaining the first elongate arm proximate said second elongate arm.

2. The jar clamp of claim 1, wherein said second elongate arm is of shorter length than said first elongate arm, and wherein said elongate arms include large outward extending handles.

3. The jar claim of claim 1, wherein said angled end portions are angled in the range of 20° to 80°.

4. A jar clamp for stabilizing a jar so as to prevent slipping and twisting of the jar during opening of the jar, for freeing both hands so that they may be free to work at opening the jar lid, and for accommodating a plurality of jar diameters, comprising:

(a) a first elongate arm and a second elongate arm, said second elongate arm hingedly attached to said first elongate arm;

(b) a seat affixed to said first elongate arm, said seat having a vertical central strut, an upper and lower cross bar perpendicular to said vertical central strut, and rubber padding secured to said vertical strut and said upper and lower cross bars, said upper and lower cross bars each having angled end portions;

(c) a rubber strap having a first and second end, said first end affixed to said second arm, said second end adapted to pass between said upper and lower cross bars, said second end adapted to be releasably secured to said first arm; and, (d) a latch comprising a hook arm having a forward securement tab and a pull tab, the latch releasably maintaining the first elongate arm proximate said second elongate arm.

5. The jar clamp of claim 4, wherein said second elongate arm is of shorter length than said first elongate arm, and wherein said elongate arms include large outward extending handles.

6. The jar claim of claim 4, wherein said angled end portions are angled in the range of 20° to 80°.

* * * * *

UNITED STATES PATENT AND TRADEMARK OFFICE

CERTIFICATE OF CORRECTION

PATENT NO. : 5,833,224

DATED : November 10, 1998

INVENTOR(S) : Mark D. Holte

It is certified that error appears in the above-indentified patent and that said Letters Patent is hereby corrected as shown below:

Column 1, line 44, begin new paragraph with -- U.S. Pat. No. 2,531,052 --

Column 1, line 52, "ofjars" should be -- of jars --.

Column 1, lines 56 and 64, "ajar" should be -- a jar --.

Column 2, line 11, "ajar" should be -- a jar --.

Signed and Sealed this

Second Day of March, 1999

*Attest:*

*Attesting Officer*

Q. TODD DICKINSON

*Acting Commissioner of Patents and Trademarks*